US007342567B2

(12) United States Patent
Park

(10) Patent No.: US 7,342,567 B2
(45) Date of Patent: Mar. 11, 2008

(54) TFT-LCD SOURCE DRIVER EMPLOYING A FRAME CANCELLATION, A HALF DECODING METHOD AND SOURCE LINE DRIVING METHOD

(75) Inventor: Jung-Tae Park, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 568 days.

(21) Appl. No.: 11/045,607

(22) Filed: Jan. 28, 2005

(65) Prior Publication Data

US 2005/0168432 A1 Aug. 4, 2005

(30) Foreign Application Priority Data

Jan. 29, 2004 (KR) ..... 10-2004-0005645

(51) Int. Cl.
*G09G 3/36* (2006.01)

(52) U.S. Cl. ..... 345/100; 345/89; 345/690; 345/204

(58) Field of Classification Search ..... 345/87–89, 345/98–100, 211–204, 690
See application file for complete search history.

(56) References Cited

U.S. PATENT DOCUMENTS 6,014,122 A * 1/2000 Hashimoto ..... 345/98
6,335,721 B1 * 1/2002 Jeong ..... 345/100
6,535,189 B1 * 3/2003 Akiyama et al. ..... 345/87
6,879,310 B2 * 4/2005 Nose ..... 345/88
7,038,652 B2 * 5/2006 Kang et al. ..... 345/98
2002/0063674 A1 5/2002 Chiang ..... 345/98

FOREIGN PATENT DOCUMENTS

| | | |
|---|---|---|
| JP | 9050261 | 2/1997 |
| KR | 20030031282 | 4/2003 |
| KR | 20030038332 | 5/2003 |

* cited by examiner

*Primary Examiner*—Duc Q Dinh
(74) *Attorney, Agent, or Firm*—F. Chau & Assoc. LLC

(57) ABSTRACT

Provided are a TFT-LCD source driver employing a frame cancellation and half decoding method, and a source line driving method. The TFT-LCD source driver outputs source line driving voltages for every two channels among a plurality of channels. Positive first and second gray scale voltages generated by a positive half decoder and negative first and second gray scale voltages generated by a negative half decoder are selectively transmitted to first and second output buffers through a chopping multiplexer in response to a chopping control signal. Output signals of the first and second output buffers are output to first and second channels through a polarity multiplexer in response to a polarity control signal.

20 Claims, 4 Drawing Sheets

TFT-LCD SOURCE DRIVER EMPLOYING A FRAME CANCELLATION, A HALF DECODING METHOD AND SOURCE LINE DRIVING METHOD

CROSS REFERENCE TO RELATED APPLICATION

This application claims the priority of Korean Patent Application No. 10-2004-0005645, filed on Jan. 29, 2004, in the Korean Intellectual Property Office, the disclosure of which is incorporated herein in its entirety by reference.

BACKGROUND OF THE INVENTION

1. Technical Field

The present invention relates to a signal driver of a liquid crystal display, and more particularly, to a TFT-LCD source driver employing a frame cancellation method and a TFT-LCD source line driving method.

2. Discussion of the Related Art

A liquid crystal display controls the light transmissivity of a liquid crystal using an electric field to display images. The liquid crystal display includes a liquid crystal display panel (TFT-LCD) in which liquid crystal cells are arranged in a matrix form and a driving circuit for driving the TFT-LCD.

FIG. 1 shows a conventional liquid crystal display. Referring to FIG. 1, a TFT-LCD 30 is constructed such that unit pixels are arranged in a matrix form. Each pixel includes a liquid crystal capacitor Cs and a switching thin film transistor TR. A gate of the thin film transistor TR is connected to a gate line 50 driven by a gate driver 10. A source of the thin film transistor TR is connected to a source line 55 driven by a source driver 20. When the thin film transistor TR, connected to the gate line 50, is turned on by an output voltage of the gate driver 10, a gray scale voltage output from the source driver 20 is applied to the liquid crystal capacitor Cs that is connected to the turned-on thin film transistor TR.

FIG. 2 shows a configuration of a conventional source driver 20. The digital R, G, B data 31, input to the source driver 20, is sampled in response to a latch enable signal output from a shift register 21 and latched in a latch 22. A data latch 23 receives and latches the sampled digital R, G, B data 31 in response to a clock signal CLK1. A D/A converter 24 decodes the digital R, G, B data 31 latched in the data latch 23 and converts the digital R, G, B data 31 to analog R, G, B signals in response to a gamma reference voltage VGMA that represents a brightness. An output buffer 25 amplifies the analog R, G, B signals and outputs them to a corresponding channel among a plurality of channels Y1, Y2, Y3, . . . , YM-2, YM-1, and YM. The channels Y1, Y2, Y3, . . . , YM-2, YM-1, and YM are connected to source lines 55 of the TFT-LCD 30 (shown in FIG. 1).

In the aforementioned configuration of the source driver 20, the channels Y1, Y2, Y3, . . . YM-2, YM-1, and YM require respective latches 22, data latches 23, D/A converters 24 and output buffers 25, in order to provide respective gray scale voltages to TFT-LCD 30. The D/A converters 24 and the output buffers 25 play an important role in deciding a chip size of the source driver 20 because they occupy a large area in the source driver 20.

For example, as the resolution of the TFT-LCD 30 increases, the number of input bits of digital R, G, B data 31 increases. Here, the size of the D/A converter 24 that decodes the digital R, G. B data 31 increases in proportion to 2 (number of bits). This increases the chip size of the source driver 20 and the number of source lines required by the TFT-LCD 30. This increase affects the power consumption of the source driver 20 and results in a deterioration of characteristics of the source driver 20.

Referring to FIG. 3, the output buffer 25 receives two gray scale voltages GA and GC, generates an intermediate value between these two voltages. It outputs the intermediate value to a corresponding channel Y1, Y2, Y3, . . . , YM-2, YM-1, or YM, in order to output gray scale voltages decoded by the D/A converter 24.

Output voltage deviation among the channels Y1, Y2, Y3, . . . , YM-2, YM-1, and YM generates stripes on the TFT-LCD 30, which deteriorates picture quality. The output voltage deviation among the channels Y1, Y2, Y3, . . . YM-2, YM-1, and YM can increase when the intermediate value between the two gray scale voltages GA and GC is output and there are mismatches between the output and the input devices. For example, mismatching of transistors 301, 302, 303 and 304, which can happen during a fabrication process, can bring about such defects in a liquid crystal display. Accordingly, the output buffer 25 can eliminate output voltage deviation among the channels Y1, Y2, Y3, . . . YM-2, YM-1, and YM only when characteristics of internal transistors 301, 302, 303 and 304 are accurately matched.

Therefore, a TFT-LCD source driver 20 that is not significantly affected by mismatching of the internal transistors of the output buffer 25 and has a reduced chip area is needed.

SUMMARY OF THE INVENTION

An exemplary embodiment of the present invention provides a TFT-LCD source driver that consecutively outputs specific frames using a frame cancellation method. Another exemplary embodiment of the present invention provides a TFT-LCD source line driving method using the TFT-LCD source driver.

In another exemplary embodiment of the present invention, there is provided a TFT-LCD source driver that outputs source line driving voltages to every two channels among a plurality of channels, the TFT-LCD source driver comprising a positive half decoder that generates positive first and second gray scale voltages. A negative half decoder that generates negative first and second gray scale voltages, is provided as well. There is a first chopping multiplexer that selectively transmits the positive first and second gray scale voltages, output from the positive half decoder, to a first output buffer in response to a chopping control signal, wherein the first output buffer amplifies the output signal of the first chopping multiplexer. There is also a second chopping multiplexer that selectively transmits the negative first and second gray scale voltages, output from the negative half decoder, to a second output buffer in response to the chopping control signal, wherein the second output buffer amplifies the output signal of the second chopping multiplexer. The TFT-LCD source driver further comprises the first and second output buffers amplifying the output signal of the respective first and second chopping multiplexer. There is also a first polarity multiplexer that selects one of output signals of the first and second output buffers and outputs it as a driving voltage of a first channel in response to a polarity control signal. There is also a second polarity multiplexer that selects one of output signals of the first and second output buffers and outputs it as a driving voltage of a second channel in response to the polarity control signal.

In another exemplary embodiment of the present invention, there is provided a TFT-LCD source line driving method comprising generating both a positive first and second gray scale voltages, as well as, a negative first and second gray scale voltages. Selectively transmitting both the positive first and second gray scale voltages to a first output buffer in response to a chopping control signal, as well as, the negative first and second gray scale voltages to a second output buffer in response to the chopping control signal. The method further comprises amplifying a corresponding gray scale voltage transmitted to the first and second output buffers. Selecting one of the output signals of the first and second output buffers and outputting it to a first channel in response to a polarity control signal. Selecting one of the output signals of the first and second output buffers and outputting it to a second channel in response to the polarity control signal. In an exemplary embodiment of the present invention the gray scale voltages output to the first and second channels are alternately applied to source lines of a TFT-LCD panel. The first and second gray scales have a difference of 2 gray levels. The first and second gray scale voltages are output to the first and second channels for every four frames. An exemplary embodiment of the present invention repeatedly outputs driving voltages having a difference of a 2 gray levels to two channels for a predetermined number of frames using a frame cancellation method that utilizes an optical illusion by which it is seen as if an intermediate gray scale voltage between the driving voltages is output. Accordingly, it is possible to prevent stripes from being generated on a TFT-LCD panel due to averaging of two gray scale voltages and mismatching of internal transistors of an output buffer in the conventional TFT-LCD source driver.

BRIEF DESCRIPTION OF THE DRAWINGS

The above and other exemplary features of the present invention will become more apparent by describing in detail exemplary embodiments thereof with reference to the attached drawings in which.

DETAILED DESCRIPTION OF PREFERRED EMBODIMENTS

Figure 4:
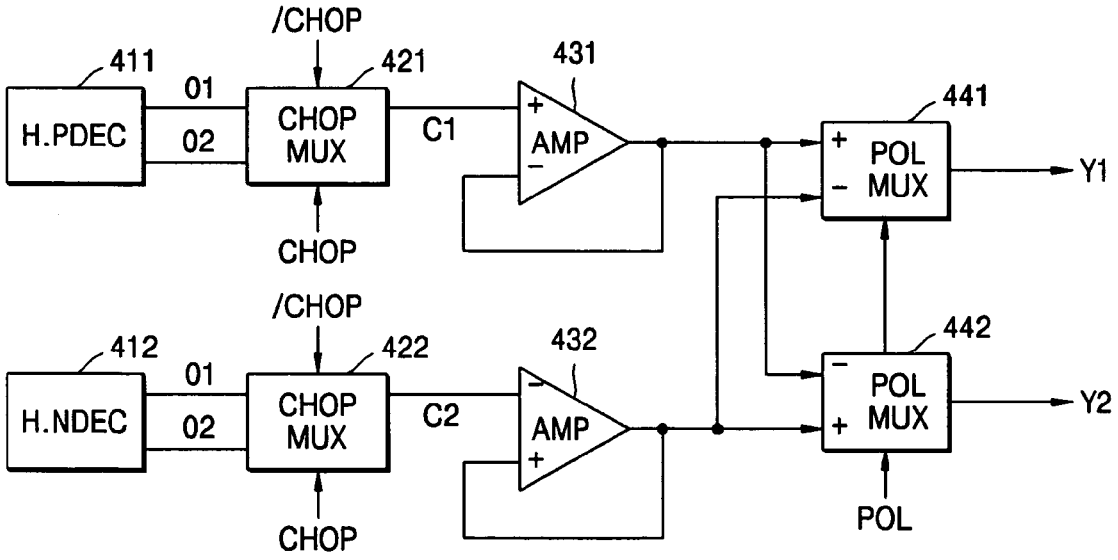
FIG. 4 is a circuit diagram that shows a TFT-LCD source driver according to an exemplary embodiment of the present invention.

An exemplary embodiment of the present invention repeatedly outputs two gray scale voltages for a predetermined number of frames using a frame cancellation method that utilizes an optical illusion, without averaging the two, such that it is seen as if an intermediate gray scale voltage between the two gray scale voltages is output. FIG. 4 shows a TFT-LCD source driver according to an exemplary embodiment of the present invention. The depicted exemplary source driver includes a positive half decoder 411, a negative half decoder 412, first and second chopping multiplexers 421 and 422, first and second output buffers 431 and 432, and first and second polarity multiplexers 441 and 442.

For convenience an exemplary embodiment of the present invention in which four frames are repeatedly output to obtain a frame cancellation effect is described herein. However, the number of frames does not have to be limited to four, and one of ordinary skill in the art will be able to modify the embodiments described herein to accomplish this. Furthermore, in an other exemplary embodiment of the present invention, source line driving voltages can be output to two adjacent channels Y1 and Y2 for each frame.

Figure 1:
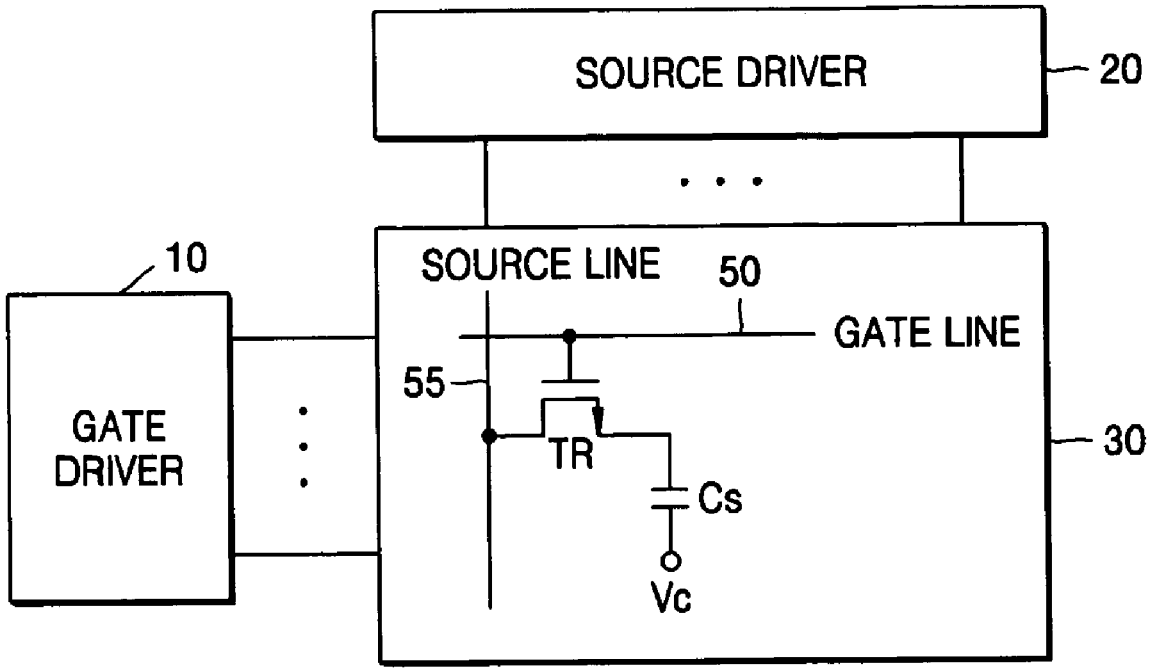
FIG. 1 (PRIOR ART)
FIG. 1 is a block diagram that shows a conventional liquid crystal display.
Figure 2:
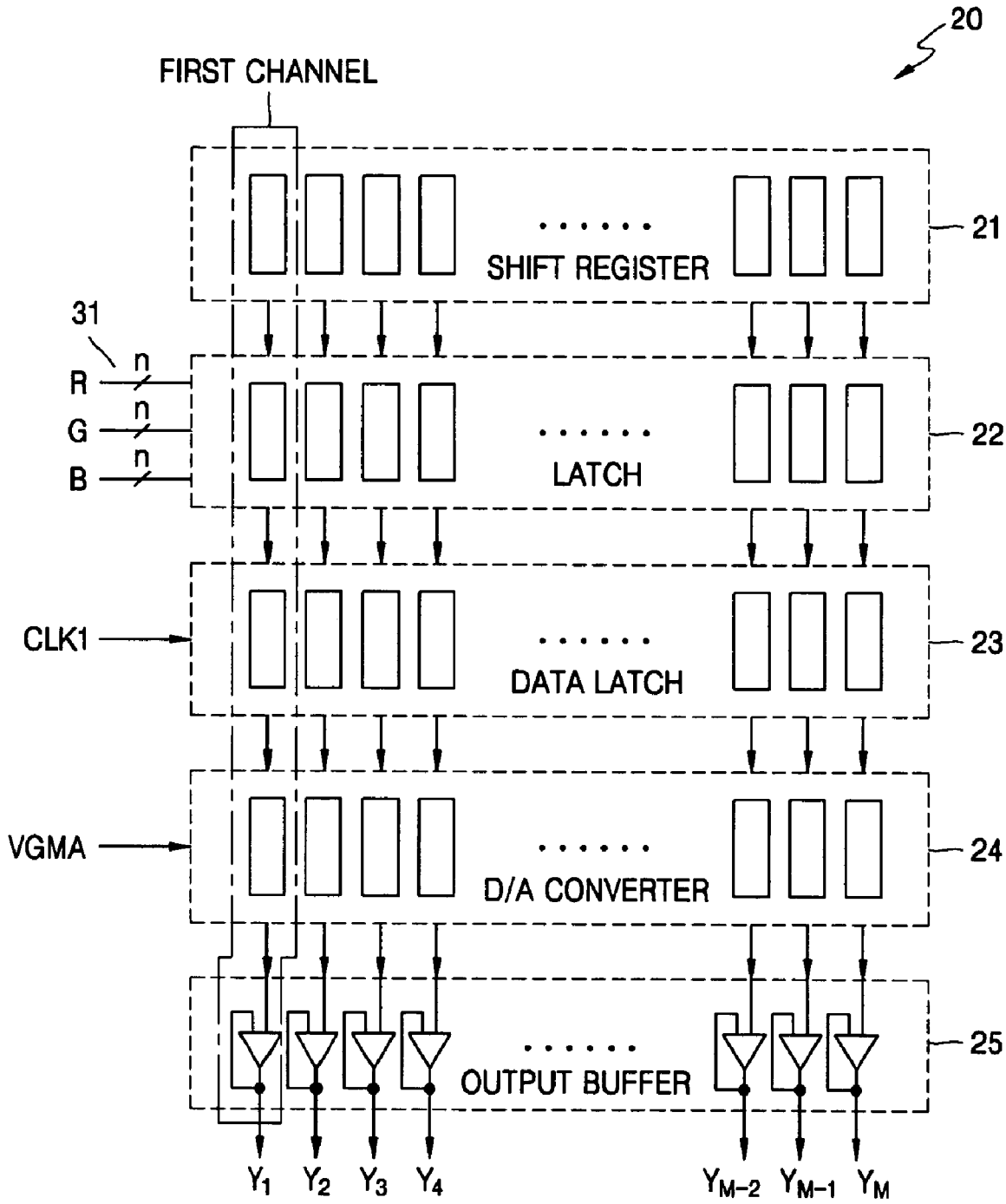
FIG. 2 (PRIOR ART)
FIG. 2 is a block diagram that shows a configuration of a conventional TFT-LCD source driver.
Figure 3:
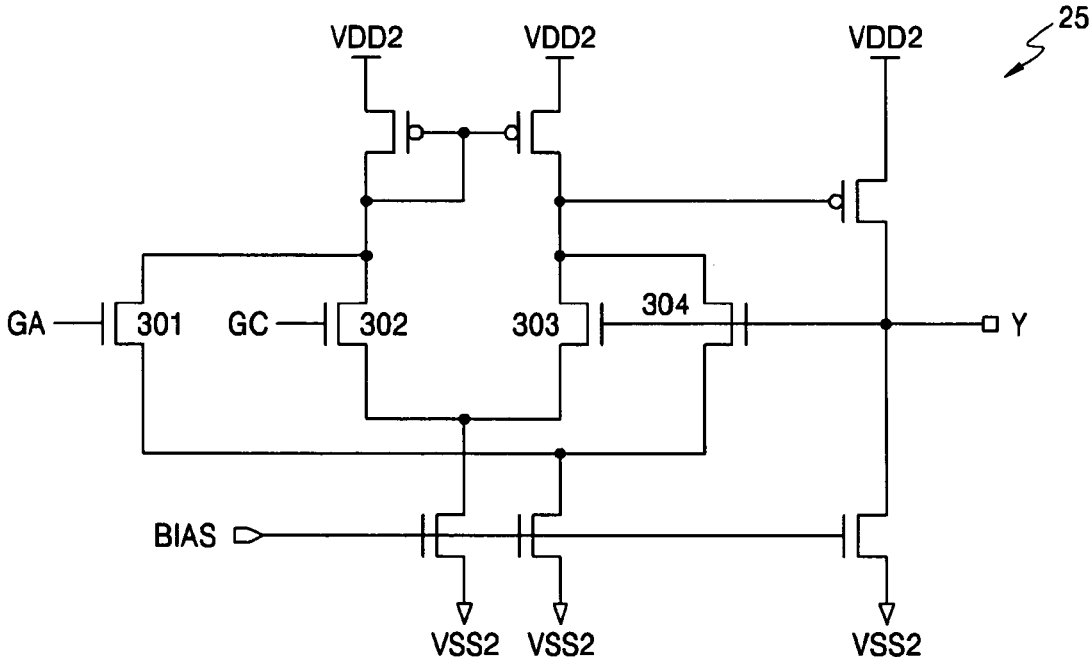
FIG. 3 (PRIOR ART)
FIG. 3 is a circuit diagram of a conventional output buffer that outputs an intermediate value between two gray scale voltages.

The positive half decoder 411 and the negative half decoder 412 are shared by the adjacent channels Y1 and Y2. The positive half decoder 411 decodes a gray scale voltage with a positive polarity, and the negative half decoder 412 decodes a gray scale voltage with a negative polarity. Since the two adjacent channels Y1 and Y2 share the positive and negative half decoders, the area of the source driver is reduced by half, compared to a case where each channel includes the positive and negative decoders. In this exemplary embodiment, the positive polarity voltage can be a voltage input from a source driver to the TFT-LCD 30 (shown in FIG. 1) that is higher than a common voltage Vc (shown in FIG. 1). Conversely, the negative polarity voltage can be a voltage input from a source driver to the TFT-LCD 30 (shown in FIG. 1) that is lower than the common voltage Vc (shown in FIG. 1).

Figure 5A:
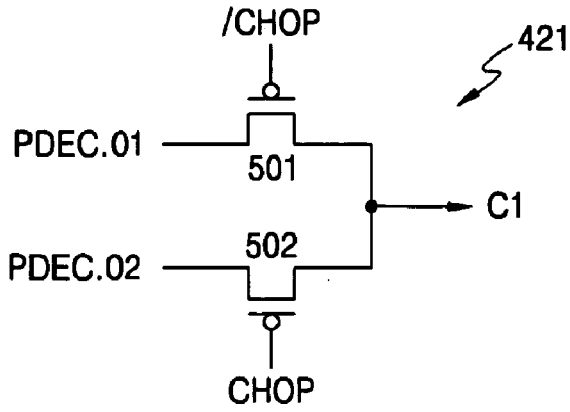
FIGS. 5A and 5B show exemplary configurations of the first and second chopping multiplexers of FIG. 4 in accordance with the present invention.
Figure 5B:
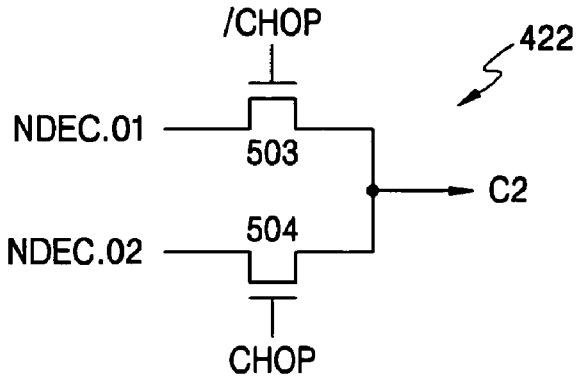

Referring to FIGS. 5A and 5B, an exemplary configuration of the first and second chopping multiplexers of FIG. 4 are depicted. The first chopping multiplexer 421, depicted in FIG. 5A, selectively transmits output voltages of the positive half decoder 411 to the first output buffer 431 in response to chopping control signals CHOP and /CHOP. For example, the first chopping multiplexer 421 transmits first and second gray scale voltages PDEC.O1 and PDEC.O2 of the positive half decoder 411 to the first output buffer 431 through first and second PMOS transistors 501 and 502, in response to an inverted chopping control signal /CHOP and a chopping control signal CHOP, respectively.

Similarly, the second chopping multiplexer 422, depicted in FIG. 5B, transmits first and second gray scale voltages NDEC.O1 and NDEC.O2 of the negative half decoder 412 to the second output buffer 432 through first and second NMOS transistors 503 and 504, in response to the inverted chopping control signal /CHOP and the chopping control signal CHOP, respectively.

Figure 6:
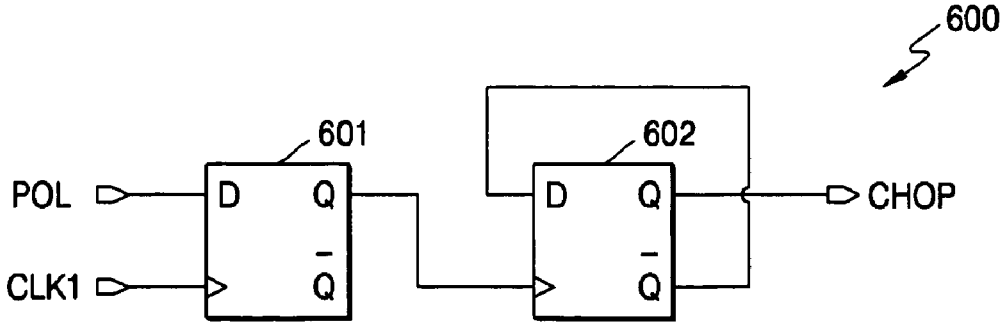
FIG. 6 shows an exemplary chopping control signal generator according to an exemplary embodiment of the present invention.

FIG. 6 depicts an exemplary embodiment of a chopping control signal generator in accordance with the present invention. The chopping control signals CHOP and /CHOP, depicted in FIGS. 5A and 5B, can be generated by a chopping control signal generator 600. The chopping signal generator 600 includes first and second D flip-flops 601 and 602. The first D flip-flop 601 outputs a polarity control signal POL in synchronization with the rising edge of a clock signal CLK1. The second D flip-flop 602 inverts the output signal of the first D flip-flop 601 and outputs the chopping control signal CHOP, in synchronization with the output signal of the first D flip-flop 601. Accordingly, the chopping control signal CHOP is synchronized with the rising edge of the clock signal CLK1 and corresponds to a signal having a period twice the period of the polarity control signal POL, that is, a signal with a frequency half the frequency of the polarity control signal POL.

Referring back to the exemplary embodiment depicted in FIG. 4, a positive input port (+) of the first output buffer 431 receives the output signal of the first chopping multiplexer 421. A negative input port (−) of the first output buffer is connected to an output port of the buffer 431, such that the output signal of the first chopping multiplexer 421 is output through the output port of the first output buffer 431. A negative input port (−) of the second output buffer 432 receives the output signal of the second chopping multiplexer 422. A positive input port (+) of the second output buffer 432 is connected to an output port of buffer 432, such that the output signal of the second chopping multiplexer 422 is output through the output port of the second output buffer 432. The first and second output buffers 431 and 432 are configured as a general voltage follower. The voltage follower is well known in the art so a detailed explanation thereof is omitted here.

The first and second polarity multiplexers 441 and 442 selectively transmit the output signals of the first and second output buffers 431 and 432, input to their positive input ports (+) and negative input ports (−), to the first and second channels Y1 and Y2, in response to the polarity control signal POL. The output of the first output buffer 431 is input into the positive input port (+) of polarity multiplexer 441 and the negative input port (−) of polarity multiplexer 442. The output of the second output buffer 432 is input into the positive input port (+) of polarity multiplexer 442 and the negative input of the polarity multiplexer 441. When the polarity control signal POL is at a logic high level, the first and second polarity multiplexers 441 and 442 output the signals input to their positive input ports (+). When the polarity control signal is at a logic low level, the first and second polarity multiplexers 441 and 442 output the signals input to their negative input ports (−).

The operation of an exemplary TFT-LCD source driver, in accordance with the present invention is discussed below. The operation of the source driver in response to the polarity control signal POL, the chopping control signal CHOP, and gray scale levels provided as the outputs O1 and O2 of the positive and negative half decoders 411 and 412, is represented in Table 1 below.

TABLE 1

| | First frame | Second frame | Third frame | Fourth frame |
|---|---|---|---|---|
| POL | + | − | + | − |
| CHOP | + | + | − | − |
| H.PDEC.O1 | 0 | 0 | 0 | 0 |
| H.PDEC.O2 | 2 | 2 | 2 | 2 |
| H.NDEC.O1 | −0 | −0 | −0 | −0 |
| H.NDEC.O2 | −2 | −2 | −2 | −2 |
| C1 | 0 | 0 | 2 | 2 |
| C2 | −2 | −2 | −0 | −0 |
| Y1 | 0 | −2 | 2 | −0 |
| Y2 | −2 | 0 | −0 | 2 |

Here, the gray scale levels provided as the outputs of the positive and negative half decoders 411 and 412 are set to 0 and 2.

Referring to Table 1, in the first frame, a driving voltage with a gray level 0 is output to the first channel Y1 and a driving voltage with a gray level −2 is output to the second channel Y2 in response to the polarity control signal POL at a logic high level and the chopping control signal at a logic high level. In the second frame, a driving voltage with a gray level −2 is output to the first channel Y1 and a driving voltage with a gray level 0 is output to the second channel Y2 in response to the polarity control signal POL at a logic low level and the chopping control signal at a logic high level. In the third frame, a driving voltage with a gray level 2 is output to the first channel Y1 and a driving voltage with a gray level −0 is output to the second channel Y2 in response to the polarity control signal POL at a logic high level and the chopping control signal at a logic low level. In the fourth frame, a driving voltage with a gray level −0 is output to the first channel Y1 and a driving voltage with a gray level 2 is output to the second channel Y2 in response to the polarity control signal POL at a logic low level and the chopping control signal at a logic low level.

As described above, for the four frames, the driving voltages with gray levels 0 and 2 and the driving voltages with gray levels −0 and −2 are repeatedly output to the first and second channels Y1 and Y2. Accordingly, it is seen as if the first and second channels Y1 and Y2 alternately output a gray level 1 and a gray level −1 for four frames. The operation of an exemplary TFT-LCD source driver in response to logic levels of the polarity control signal POL and the chopping control signal CHOP is represented in Table 2 below.

TABLE 2

| | First frame | Second frame | Third frame | Fourth frame |
|---|---|---|---|---|
| POL | − | + | − | + |
| CHOP | + | − | − | + |
| H.PDEC.O1 | 0 | 0 | 0 | 0 |
| H.PDEC.O2 | 2 | 2 | 2 | 2 |
| H.NDEC.O1 | −0 | −0 | −0 | −0 |
| H.NDEC.O2 | −2 | −2 | −2 | −2 |
| C1 | 0 | 2 | 2 | 0 |
| C2 | −2 | −0 | −0 | −2 |
| Y1 | −2 | 2 | −0 | 0 |
| Y2 | 0 | −0 | 2 | −2 |

Accordingly, exemplary embodiments of the present invention output driving voltages having a difference of two gray levels to the first and second channels Y1 and Y2 for four frames so it seems as if a different gray level, corresponding to an intermediate value between the two gray levels, is output.

It should also be understood that the above description is only representative of illustrative embodiments. Other applications and embodiments can be straightforwardly implemented without departing from the spirit and scope of the present invention. It is therefore intended, that the invention not be limited to the specifically described embodiments, but the invention is to be defined in accordance with that claims that follow.

What is claimed is:

1. A TFT-LCD source driver that outputs source line driving voltages to every two channels among a plurality of channels, the TFT-LCD source driver comprising:

a positive half decoder that generates a positive first and second gray scale voltages;

a negative half decoder that generates a negative first and second gray scale voltages;

a first chopping multiplexer that selectively transmits the positive first and second gray scale voltages, output from the positive half decoder, to a first output buffer in response to a chopping control signal, wherein the first output buffer amplifies the output signal of the first chopping multiplexer;

a second chopping multiplexer that selectively transmits the negative first and second gray scale voltages, output from the negative half decoder, to a second output buffer in response to the chopping control signal, wherein the second output buffer amplifies the output signal of the second chopping multiplexer;

a first polarity multiplexer that selects one of output signals of the first and second output buffers and outputs it as a driving voltage of a first channel in response to a polarity control signal; and a second polarity multiplexer that selects one of output signals of the first and second output buffers and outputs it as a driving voltage of a second channel in response to the polarity control signal.

2. A TFT-LCD source driver of claim 1, wherein the first and second gray scale voltages have a gray level n and a gray level (n+2), respectively, n being an even, natural number (n=0, 2, 4, 6, 8, . . . ).

3. A TFT-LCD source driver of claim 1, wherein the first and second gray scale voltages have a gray level n and a gray level (n+2), respectively, n being an odd, natural number (n=1, 3, 5, 7, 9, . . . ).

4. A TFT-LCD source driver of claim 1, wherein the first chopping multiplexer includes:

a first PMOS transistor that transmits the positive first gray scale voltage of the positive half decoder to the first output buffer in response to an inverted chopping control signal; and a second PMOS transistor that transmits the positive second gray scale voltage of the positive half decoder to the first output buffer in response to the chopping control signal.

5. A TFT-LCD source driver of claim 1, wherein the second chopping multiplexer includes:

a first NMOS transistor that transmits the negative first gray scale voltage of the negative half decoder to the second output buffer in response to the inverted chopping control signal; and a second NMOS transistor that transmits the negative second gray scale voltage of the negative half decoder to the second output buffer in response to the chopping control signal.

6. A TFT-LCD source driver of claim 1, further comprising:

a chopping control signal generator that generates the chopping control signal, the chopping control signal generator including a first flip-flop that receives and outputs the polarity control signal in response to a first clock signal, and the chopping control signal generator also including a second flip-flop that has an input port connected to an inverted output port of the second flip-flop and outputs a signal, input to the input port in response to the output signal of the first flip-flop, as the chopping control signal.

7. A TFT-LCD source driver of claim 1, wherein the first polarity multiplexer has a first input port that receives the output signal of the first output buffer and a second input port that receives the output signal of the second output buffer, whereby the first polarity multiplexer outputs the signal input to the first input port, to the first channel in response to a first logic level of the polarity control signal and outputs the signal input to the second input port, to the first channel in response to a second logic level of the polarity control signal.

8. A TFT-LCD source driver of claim 1, wherein the second polarity multiplexer has a first input port that receives the output signal of the second output buffer and a second input port that receives the output signal of the first output buffer, whereby the second polarity multiplexer outputs the signal input to the first input port, to the second channel in response to a first logic level of the polarity control signal and outputs the signal input to the second input port, to the second channel in response to a second logic level of the polarity control signal.

9. A TFT-LCD source driver of claim 1, wherein the first and second gray scale voltages are output to the first and second channels for every four frames.

10. A TFT-LCD source driver of claim 1, wherein the chopping control signal both is synchronized with a first clock signal and has a period twice the period of the polarity control signal.

11. A TFT-LCD source line driving method comprising:

generating a positive first and second gray scale voltages;

generating a negative first and second gray scale voltages;

selectively transmitting the positive first and second gray scale voltages to a first output buffer in response to a chopping control signal;

selectively transmitting the negative first and second gray scale voltages to a second output buffer in response to the chopping control signal;

amplifying a corresponding gray scale voltage transmitted to the first output buffer;

amplifying a corresponding gray scale voltage transmitted to the second output buffer;

selecting one of the output signals of the first and second output buffers and outputting it to a first channel in response to a polarity control signal; and selecting one of the output signals of the first and second output buffers and outputting it to a second channel in response to the polarity control signal.

12. A method of claim 11, wherein the gray scale voltages output to the first and second channels are alternately applied to source lines of a TFT-LCD panel.

13. A method of claim 11, wherein the first and second gray scale voltages have a gray level n and a gray level (n+2), respectively, n being an even, natural number (n=0, 2, 4, 6, 8, . . . ).

14. A method of claim 11, wherein the first and second gray scale voltages have a gray level n and a gray level (n+2), respectively, n being an odd, natural number (n=1, 3, 5, 7, 9, . . . ).

15. A method of claim 11, wherein the first and second gray scale voltages are output to the first and second channels for every four frames.

16. A method of claim 11, wherein the chopping control signal is generated by:

synchronizing a polarity control signal in response to a clock signal;

inverting the synchronized polarity control signal, creating an inverted control signal; and generating the chopping control signal by outputting the inverted control signal in synchronization with the synchronized polarity control signal.

17. A method of claim 11, wherein selecting one of the outputs signals of the first and second output buffers and outputting it to the first channel in response to the polarity control signal further comprising:

selecting the first output buffer in response to a first logic level of the polarity control signal selecting the second output buffer in response to a second logic level of the polarity control signal.

18. A method of claim 11, wherein selecting one of the outputs signals of the first and second output buffers and outputting it to the second channel in response to the polarity control signal further comprising:

selecting the second output buffer in response to a first logic level of the polarity control signal selecting the first output buffer in response to a second logic level of the polarity control signal.

19. A method of claim 11, wherein the chopping control signal is both synchronized to a first clock signal and has a period twice the period of the polarity control signal.

20. A method of claim 11, wherein the method uses a frame cancellation method that utilizes an optical illusion to make it seem as if an intermediate gray scale voltage is being output.

* * * * *